US008001981B2

(12) United States Patent
Jeong et al.

(10) Patent No.: US 8,001,981 B2
(45) Date of Patent: Aug. 23, 2011

(54) ELECTRIC MASCARA

(75) Inventors: HaeWon Jeong, Anyang-si (KR); JuHo Kim, Anyang-si (KR)

(73) Assignee: Amorepacific Corporation, Seoul (KR)

( * ) Notice: Subject to any disclaimer, the term of this patent is extended or adjusted under 35 U.S.C. 154(b) by 647 days.

(21) Appl. No.: 11/914,444

(22) PCT Filed: Oct. 21, 2005

(86) PCT No.: PCT/KR2005/003515

§ 371 (c)(1),
(2), (4) Date: Nov. 14, 2007

(87) PCT Pub. No.: WO2006/132459

PCT Pub. Date: Dec. 14, 2006

(65) Prior Publication Data

US 2008/0210254 A1 Sep. 4, 2008

(30) Foreign Application Priority Data

Jun. 10, 2005 (KR) ..... 20-2005-0016643 U
Jun. 10, 2005 (KR) ..... 20-2005-0016644 U
Sep. 30, 2005 (KR) ..... 20-2005-0028145 U

(51) Int. Cl.
*A45D 40/26* (2006.01)

(52) U.S. Cl. ..... 132/218

(58) Field of Classification Search ..... 132/218, 132/320; 401/122, 129, 126, 118, 121, 130
See application file for complete search history.

(56) References Cited

U.S. PATENT DOCUMENTS 2,458,063 A * 1/1949 Dulberg ..... 132/314
6,616,366 B1 9/2003 Weihrauch et al.

FOREIGN PATENT DOCUMENTS

JP 17-095531 A2 4/2005
JP 2005095531 A * 4/2005

* cited by examiner

*Primary Examiner* — Robyn Doan
(74) *Attorney, Agent, or Firm* — John K. Park; Park Law Firm

(57) ABSTRACT

Provided is an electric mascara capable of not only preventing eyelash from being pulled out when it is made up by improving a brush but also enabling to comb up eyelash in order without deformation. An electric mascara includes a rubber brush where tooth are formed by consecutive thread and groove, and being installed to the end portion of a wand; a decelerator-attached motor; and a power switch to provide power with the motor.

6 Claims, 11 Drawing Sheets

[Fig. 1] Prior Art
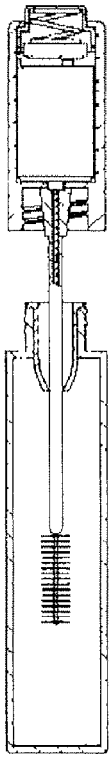
[Fig. 2] Prior Art
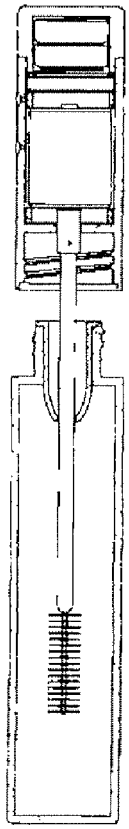

[Fig. 3] Prior Art
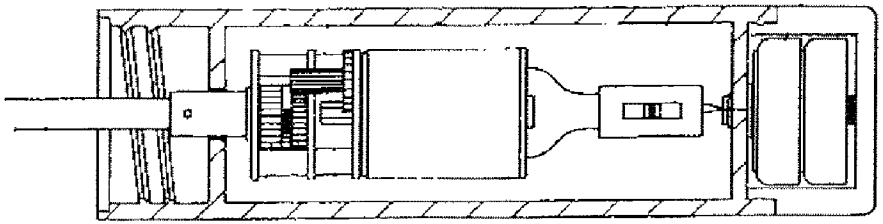

[Fig. 4] Prior Art
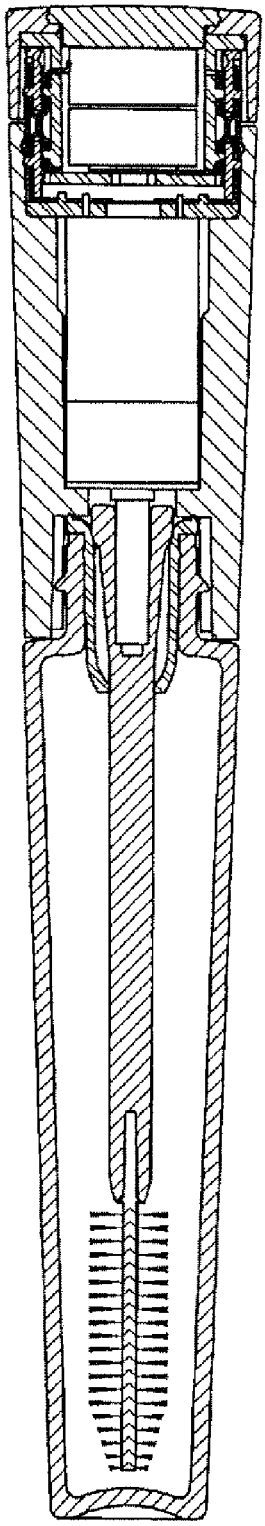

[Fig. 5] Prior Art
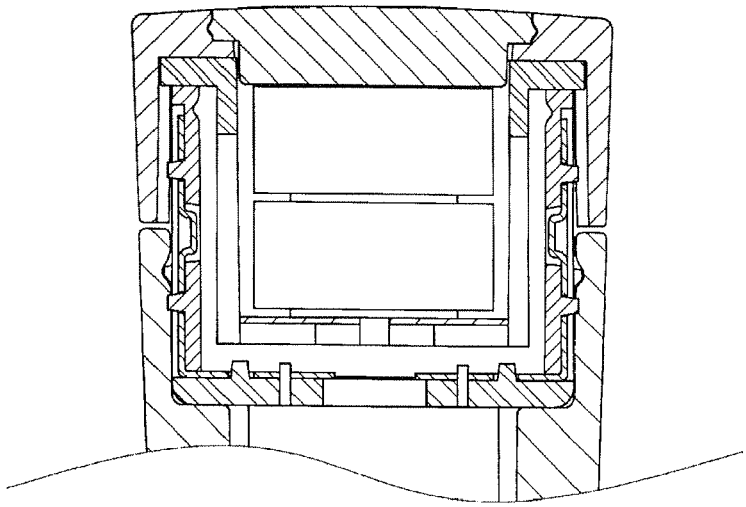
[Fig. 6] Prior Art
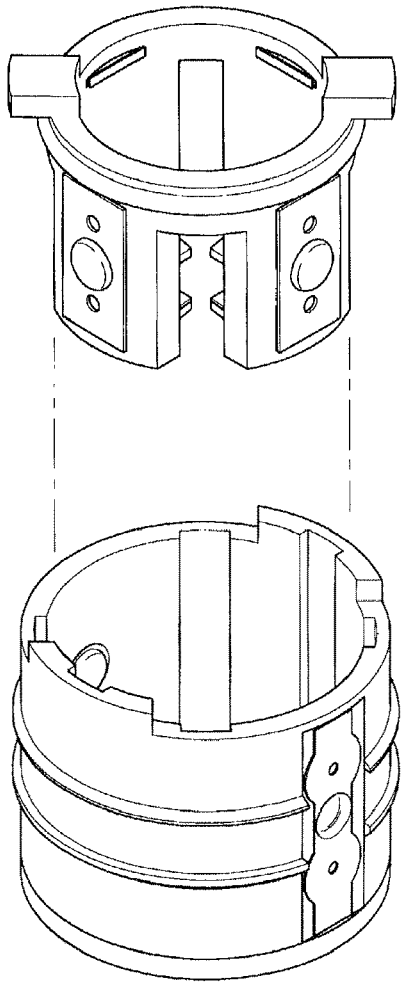

[Fig. 7] Prior Art
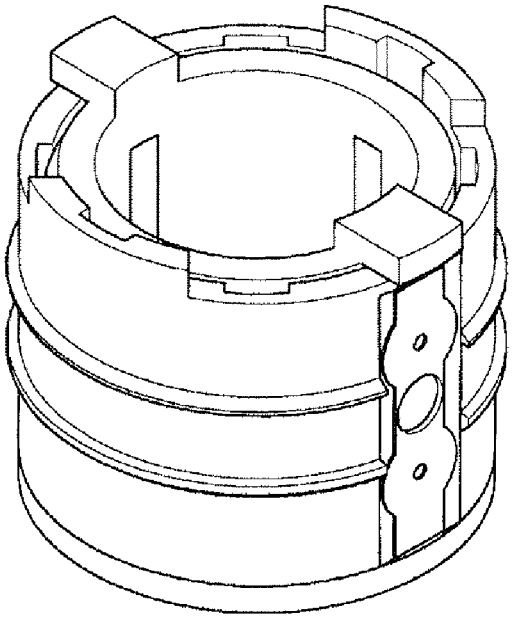

[Fig. 8]
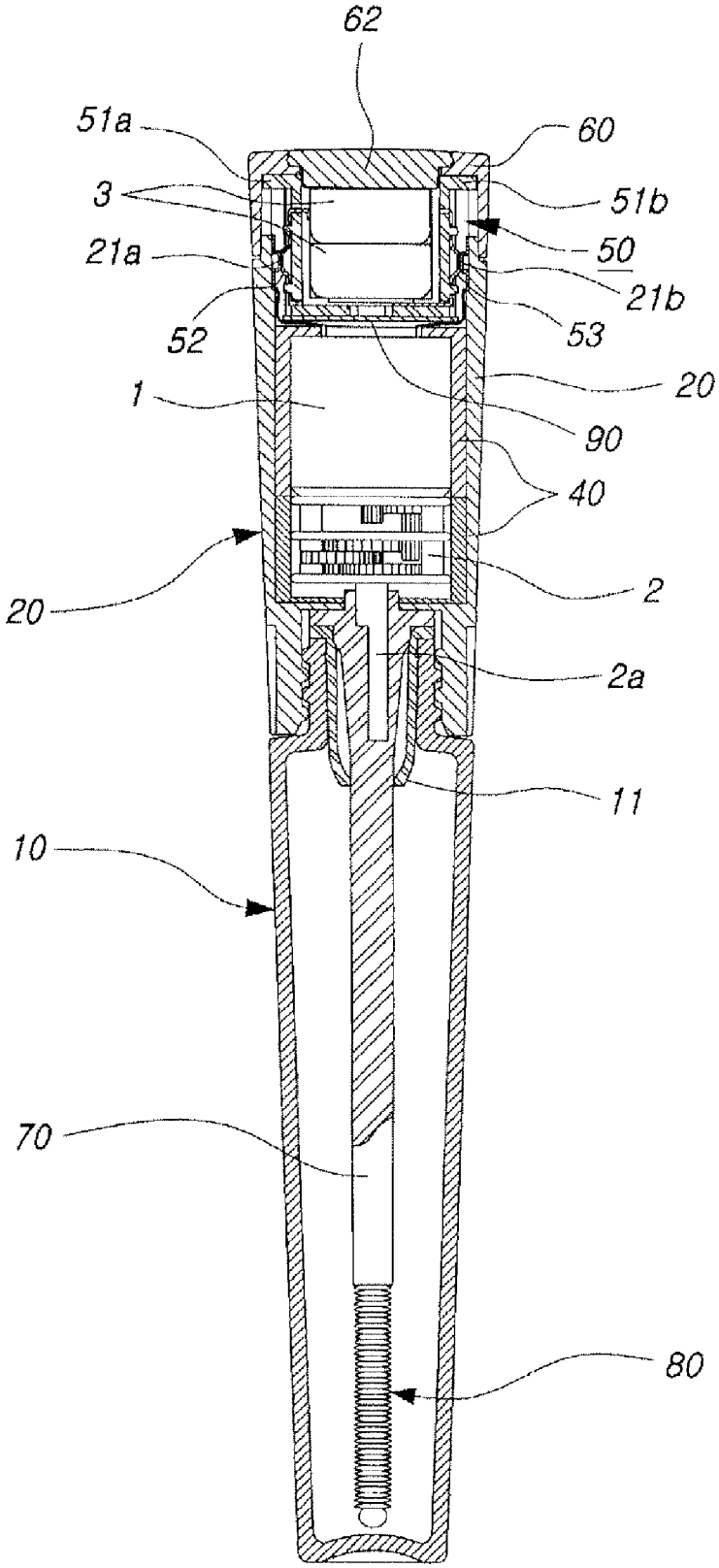

[Fig. 9]
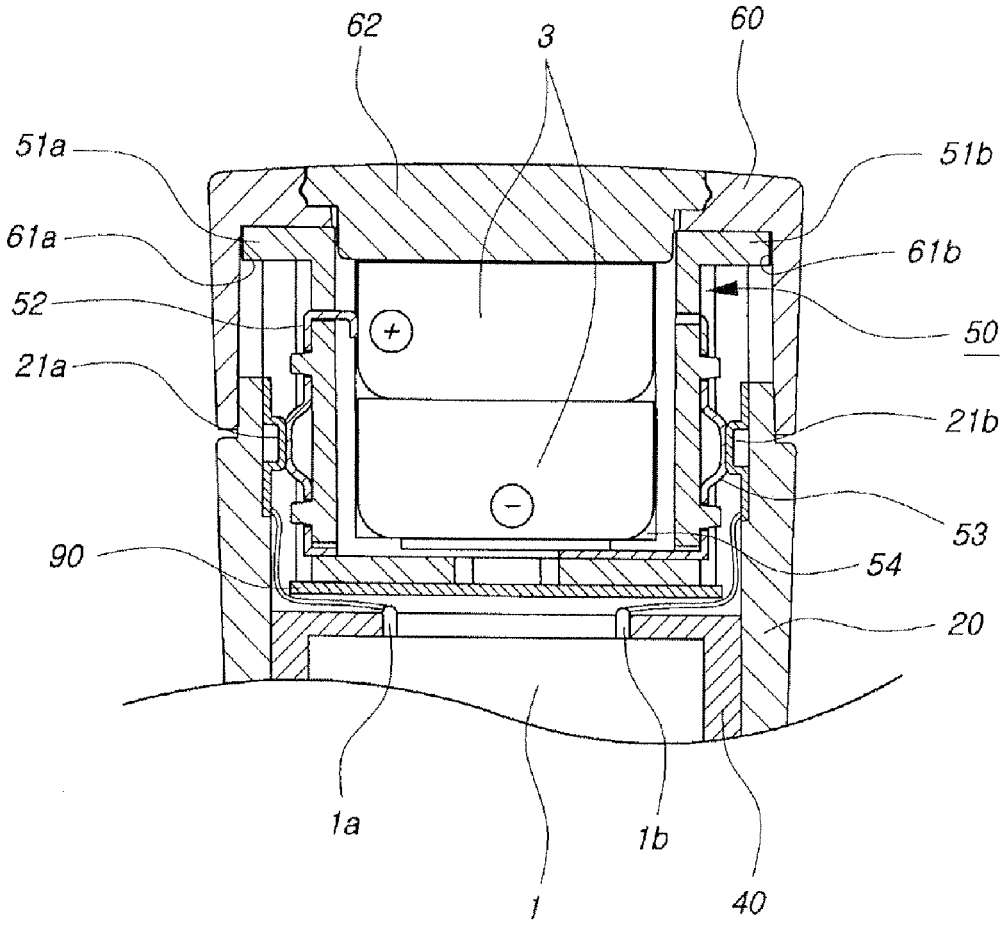

[Fig. 10]
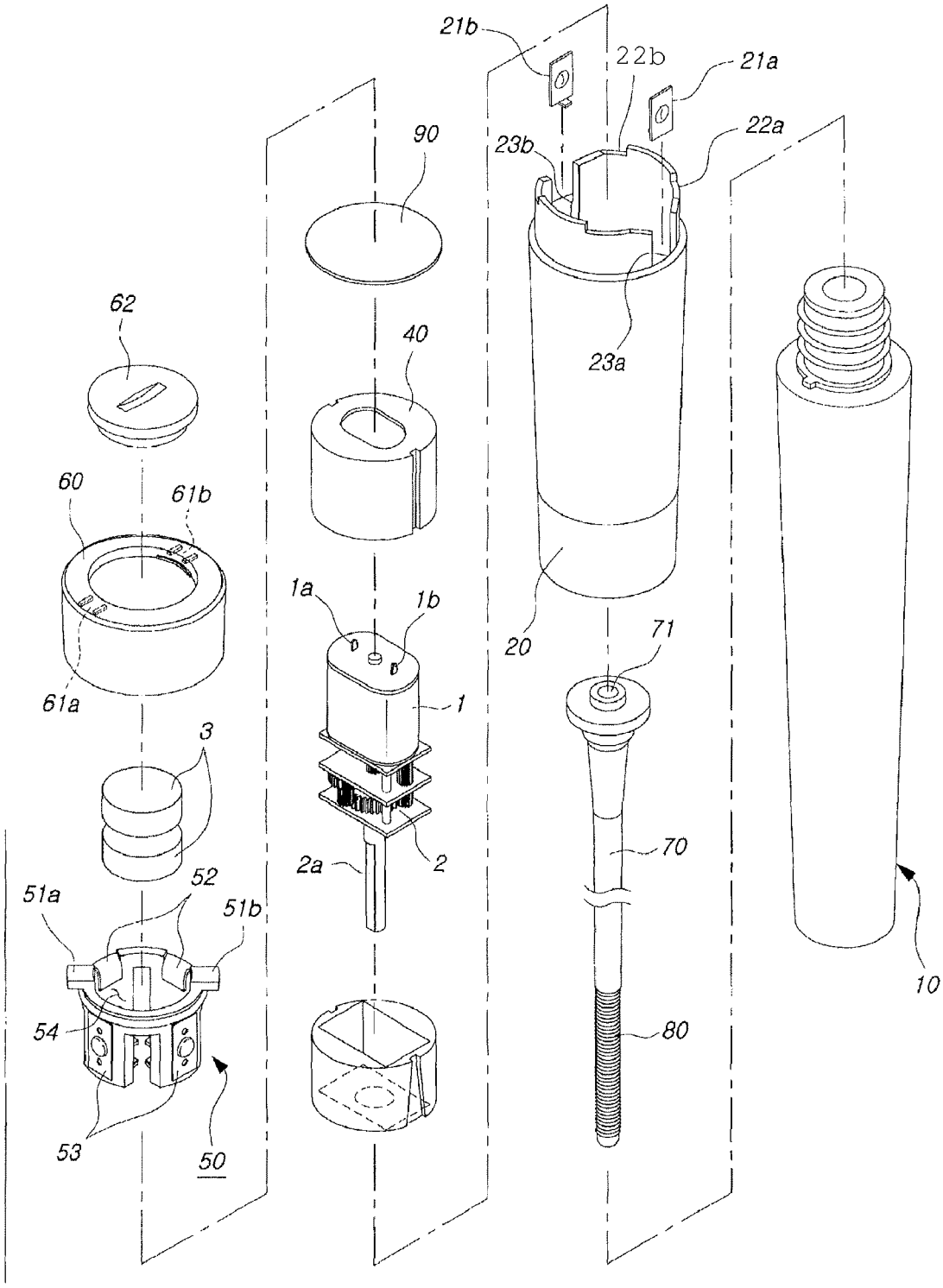

[Fig. 11]
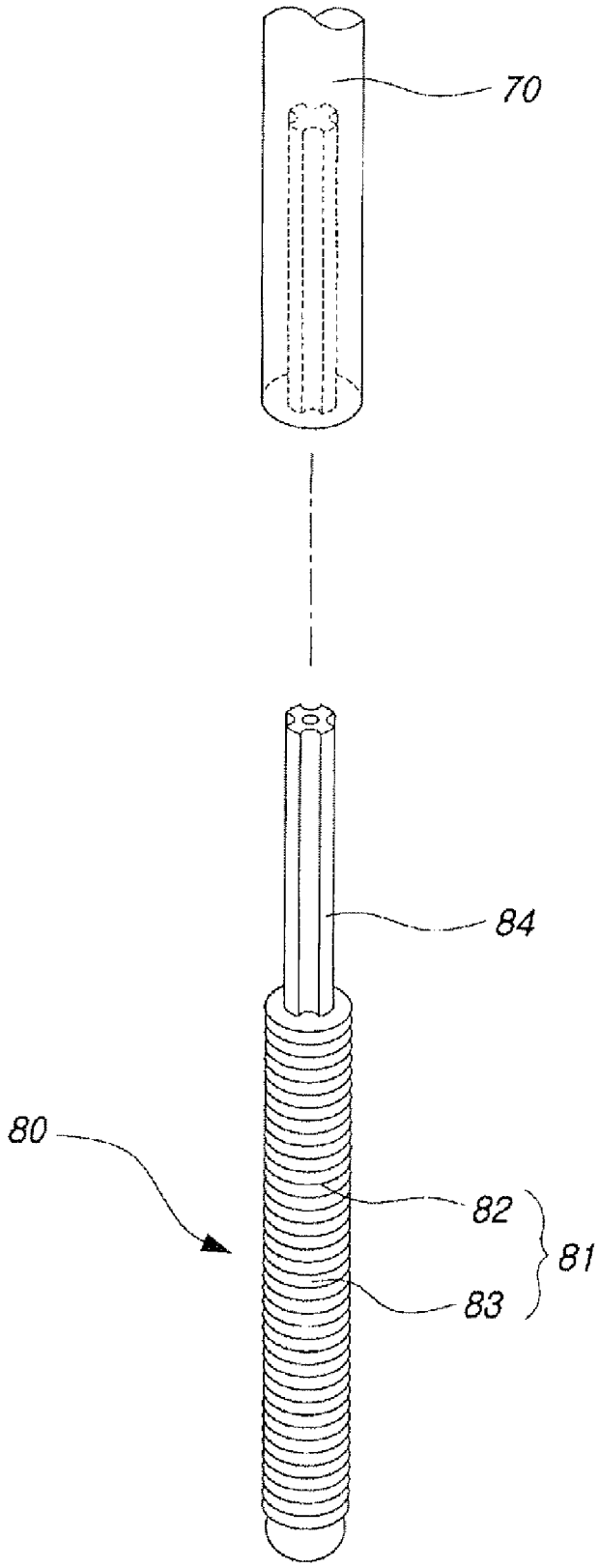

[Fig. 12]
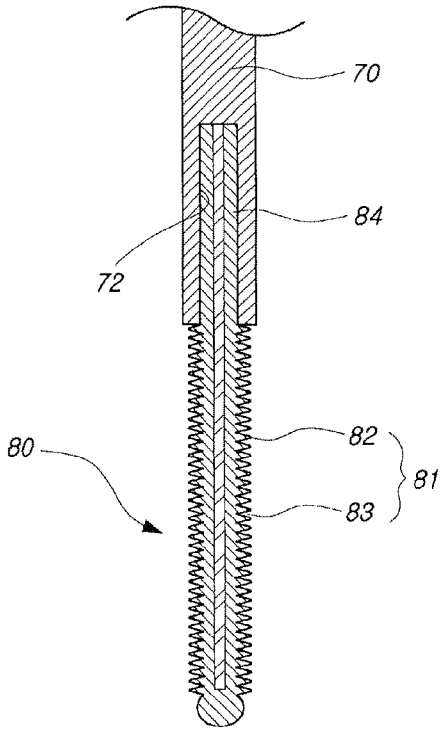
[Fig. 13]
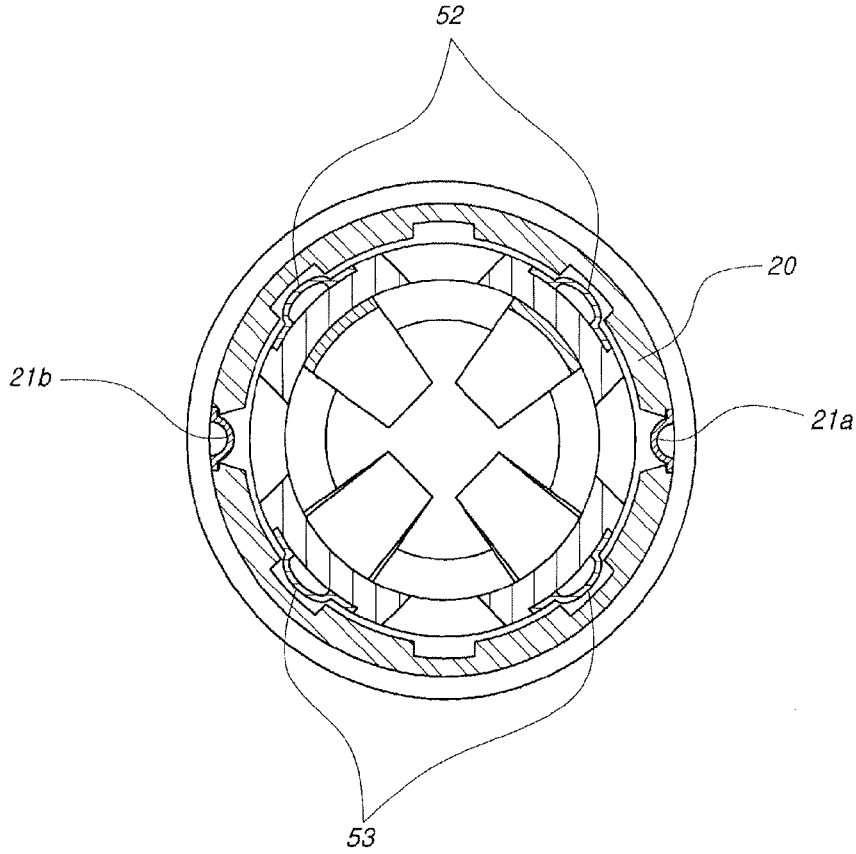

[Fig. 14]
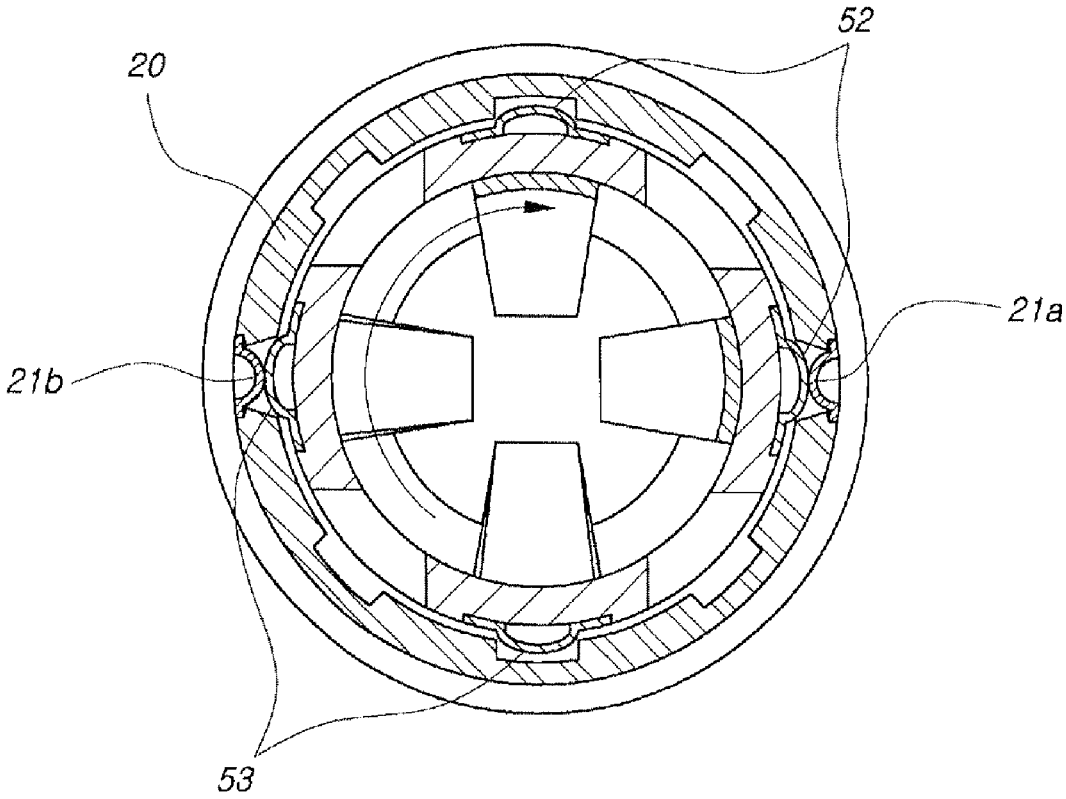
[Fig. 15]
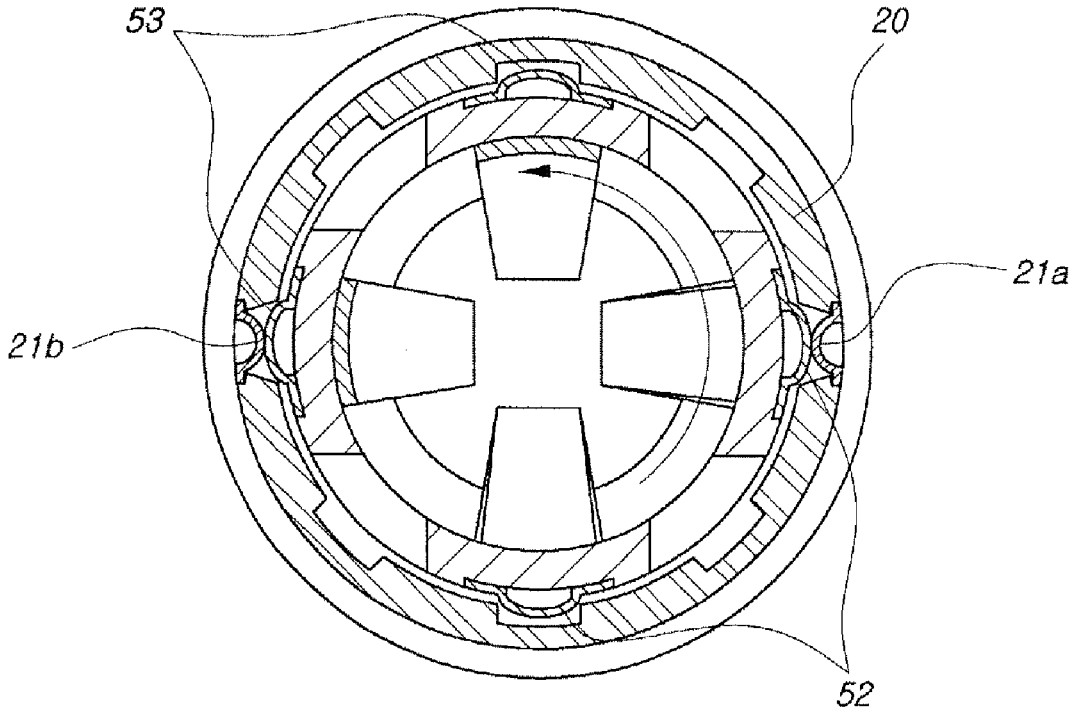

ELECTRIC MASCARA

TECHNICAL FIELD

The present invention relates to a electric mascara more particularly, relates to a electric mascara capable of not only preventing eyelash from being pulled out when it is made up by improving a brush but also enabling to comb up eyelash in order without deformation. The present invention also relates to electric mascara having a rotary switch with a simplified structure to operate a motor and reducing an amount of vibration noise generated from the motor.

BACKGROUND ART

The mascara is a kind of cosmetic equipments for making up eyelash so that it can be looked longer and thicker. It makes eyelash waved so that eyelash can be looked with beauty, for eyelash stretches itself toward its tip straightly, As a representative type of the mascaras, there is a manual one which is rolled by a user for making up eyelash.

However, such the manual type mascara gives beginner difficulties in curling up eyelash and even in creating a beautiful eyelash because it is difficult to curl up the tip of eyelash roundly with it. What is worse, eyelash are clung together because beginner is so unskillful to comb up eyelash while rolling a mascara brush roundly that mascara solution cannot be applied uniformly.

Various types of electric mascaras to solve above problems, as shown in FIGS. 1 through 7, were filed and registered by applicant of the present invention, FIG. 1 shows an electric mascara disclosed on a registered Korean Utility Patent No. 326,065; FIG. 2 shows another electric mascara disclosed on a registered Korean Utility Patent No. 341,762; FIG. 3 shows still another electric mascara disclosed on a registered Korean Utility Patent No. 334,143; FIG. 4 shows still another electric mascara having a sealed structure disclosed on a registered Korean Utility Patent No. 356,873; and FIGS. 5 through 7 show a rotary switch of an electric mascara disclosed on a registered Utility Korean Patent No. 358,513. It can be seen that various ideas were provided on the electric mascara.

Those mascaras are advantageous in that everyone can decorate eyelash easily because a wand is rotated by a motor.

However, performances of those electric mascaras to rotate a brush automatically for making up eyelash are much different depending on a kind of the brush used to comb up eyelash.

A brush used to the electric mascara, so called a brush with bristles, is made up by twisting plastic bristles with a wire core. Such the brush with bristles has bristles inserted to the wire core in spiral manner because the wire core is twisted in spiral manner when the brush is made with bristles inserted. Thus, it can be happened that eyelash cannot be combed uniformly or eyelash is strained to a side when it is curled up with the brush with bristles installed to the electric mascara.

Further eyelash happens to be tangled together when it is combed up as well as the hair happens to be tangled or pulled out when the hair is combed with a comb. Even further, it can be happened that eyelash is tangled with bristles and pulled out eventually when the brush with bristles is rotated.

In other hand, although a rotary switch, as shown in FIGS. 5 through 7, is used in order to improve functionality of the mascara and to switch a rotational direction of the brush freely, cost to produce the mascara is increased because a structure of the rotary switch is very complex.

Further, those electric mascaras have a problem where quite a loud noise is produce by a motor.

DISCLOSURE OF INVENTION

Technical Problem

The present invention is designed to solve at least one of those problems. An object of the present invention is to provide an electric mascara having a rubber brush installed on the end portion of a wand where thread and groove are continued along its circumstance so that a disk type tooth is formed, whereby eyelash can be combed in order without being strained when it is combed up with the electric mascara operated electrically.

The electric mascara according to the present invention can solve problems such as strain caused by eyelash tangling, extraction of eyelash, etc. Further the electric mascara according to the present invention can reduce an amount of noise generated from a motor and a decelerator by covering the motor and the decelerator with a silicon cover and installing them into a mascara cover. And the electric mascara according to the present invention can reduce cost by simplifying the structure of a rotary switch for switching a rotational direction and starting of the motor.

Technical Solution

To achieve the above object, the present invention provides electric mascara having a wand which is rotated by a motor installed in a mascara cover, the electric mascara includes:

a rubber brush 80 where tooth 81 are formed by consecutive thread 82 and groove 83, and being installed to the end portion of the wand 80;

a decelerator-attached motor 1; and a power switch to provide power with the motor.

It is preferable that the electric mascara further includes a silicon cover 40 for reducing an amount of noise generated from the motor and a simplified rotary switch 50.

Advantageous Effects

The electric mascara according to the present invention can make eyelash combed in order without straining when eyelash is combed up electrically, solve not only tangling of eyelash but also strain of eyelash and extraction of eyelash resulted by the brush with bristles by adopting a rubber brush installed on the end portion of a wand where thread and groove are continued along its circumstance, as if a plurality of disks are piled up, such that tooth is formed.

Further the electric mascara according to the present invention can dramatically reduce an amount of noise generated from a motor 1 and decelerator 2 by covering the motor 1 and the decelerator 2 with a silicon cover 40 and installing them into a mascara cover 20. Further the electric mascara according to the present invention can minimize factors to increase cost of the product which has been caused by complexity and variety of parts of rotary switch 50 by simplifying the structure of the rotary switch for initiating the motor 1 and switching a rotational direction of the motor 2.

BRIEF DESCRIPTION OF THE DRAWINGS

FIG. 1 shows conventional electric mascara;

FIG. 2 shows conventional electric mascara;

FIG. 3 shows still conventional electric mascara;

FIG. 4 shows still conventional electric mascara;

FIG. 5 shows a conventional rotary switch of electric mascara;

FIG. 6 shows a disassembled view of the conventional rotary switch shown in FIG. 5;

FIG. 7 shows an assembled view of the conventional rotary switch shown in FIG. 6;

FIG. 8 shows a perspective view of the electric mascara according to the present invention;

FIG. 9 shows an enlarged view of a mascara cover of the electric mascara according to the present invention;

FIG. 10 shows a perspective view of the mascara cover of the electric mascara according to the present invention;

FIG. 11 shows a perspective view of a rubber brush of the electric mascara according to the present invention;

FIG. 12 shows an assembled view of the rubber brush of the electric mascara according to the present invention;

FIG. 13 shows a rotary switch in the state where the electric mascara according to the present invention is turned off;

FIG. 14 shows the rotary switch in the state where the rubber brush rotates clockwise as a handle is rotated in a forward direction in the electric mascara according to the present invention; and FIG. 15 shows the rotary switch in the state where the rubber brush rotates counterclockwise as the handle is rotated in a reverse direction in the electric mascara according to the present invention.

DESCRIPTION OF THE PARTS

10. mascara container 20. mascara cover
21*a*, 21*b*; poll contacting pieces 22*a*, 22*b*; operating grooves
23*a*, 23*b*; fixing holders 40. silicon cover
50. rotary switch 51*a*, 51*b*; activity restriction protrusions
52; battery plus contacting terminal 53; battery minus contacting terminal
60; rotating handle 61*a*, 61*b*; restriction grooves
62; battery cab 70; wand
71: D-cutting hole 72: assembling hole
80; rubber brush 81; tooth
82; thread 83; groove
90; sliding plate

BEST MODE FOR CARRYING OUT THE INVENTION

The electric mascara of the present invention will now be described in detail taken into drawings accompanied.

The electric mascara of the present invention includes container 10 to contain mascara solution, a mascara cover 20 on which a rubber brush 80 is installed through a wand 70. The rubber brush 80 is used to apply the mascara solution contained in the mascara container 10 to eyelash for eyelash make-up.

The mascara container 10 has a blade 11 on its opening portion so that an amount of mascara solution as much as suitable can be maintained on the rubber brush 80.

A motor 1 and a decelerator 2 to decelerate the rotation speed of the motor 1 are installed inside the mascara cover 20. A rotary switch 50 containing a battery 3 to operate the motor 1 is installed above the motor 1.

The motor 1 and the decelerator 2 are sealed with a silicon cover 40 in order to block vibration noise generated when the motor 1 and the decelerator 2 are operated.

It is preferable to decelerate the rotation speed of the motor 1 by using the decelerator 2 so that the rotation speed of the rubber brush 80, which is operated by the motor 1, is maintained within the range of 25 rpm ~30 rpm.

If the rotation speed of the rubber brush 80 is slower than 25 rpm, lumping of mascara solution can be occurred and thereby, consumer gets impatient on use.

Otherwise if the rotation speed of the rubber brush 80 is faster than 30 rpm, the mascara solution can be dried out even before eyelash makeup is completed. Further it is difficult to touch eyelash with the rubber brush 80 because of quite a fast speed of the brush 80. There is even a potential problem to hurt user's eyeball.

The wand 70 is connected to a rotation axis 2*a* of the decelerator 2 in the manner of D-cutting connection. The rubber brush 80 is installed on the end portion of the wand 70.

The rubber brush 80 has tooth 81 which is shaped by consecutive thread and groove along the circumstance of the wand 70.

The tooth 81 is shaped as if pluralities of disk are piled and gets angled at a right angle relative to the longitudinal direction.

The rotary switch 50, which supplies a power of a battery 3 with the motor 1 selectively, has a battery plus contacting terminal 52 and a battery minus contacting terminal 53 as shown in FIG. 9. The plus contacting terminal 52 can be selectively connected to a pole contacting piece 21*a*, which is connected to a plus pole terminal 1*a* of the motor 1, while being connected to a plus pole of the battery 3. The battery minus contacting terminal 53 can be selectively connected to a pole contacting piece 21*b*, which is connected to a minus pole terminal 1*a* of the motor 1, while being connected to a minus pole of the battery 3.

Activity restriction protrusions 51*a* and 51*b* of the rotary switch 50 operate within operating grooves 22*a* and 22*b*, respectively. Operating grooves 22*a* and 22*b* are formed on the upper contacting part of the mascara cover 20 where pole contacting pieces 21*a* and 21*b* are installed. Activity restriction protrusions 51*a* and 51*b* are inserted into corresponding respective restriction grooves 61*a* and 61*b*, respectively. Restriction groove2 61*a* and 61*b* are formed inside of the rotating handle 60 of the mascara cover 20. When rotating the handle 60 rotates from side to side, the activity restriction protrusions 51*a* and 51*b* are rotated and thereby the battery plus contacting terminal 52 and the battery minus contacting terminal 53 are selectively connected to the pole contacting pieces 21*a* and 21*b*, which provide power with the motor 1, respectively.

A battery settling groove 54 for settling the battery 3 is provided at the center of the rotary switch 50.

A battery cap 62 is provided on the rotating handle 60 so that the battery 3 is changed after lifetime.

The rotary switch 50 is installed above the motor 1 and it can be slit by the sliding plate 90 from side to side.

The motor 1 and the decelerator 2 are covered by the silicon cover 40 and they are inserted into the mascara cover 20 in downward direction.

Where, the pole contacting pieces 21*a* and 21*b* are fixed within corresponding fixing holder 23*a* and 23*b* respectively. The pole contacting pieces 21*a* and 21*b* are connected to the plus and minus terminals 1*a* and 1*b* of the motor 1 by wires while the fixing holders 23*a* and 23*b* are formed inside of the upper portion of the mascara cover 20.

After the motor 1 and the decelerator 2 are assembled each other, the sliding plate 90 is placed over the motor 1.

After that, the rotary switch 60 is assembled.

When the rotary switch 60 is assembled, the rotating handle 60 is installed to the top portion of the mascara cover 20 in the manner of under-cut connection after the activity restriction protrusions 51*a* and 51*b* are assembled at the center of the operating groove 22*a* and 22*b*, which are formed with upper contacting portion of the mascara cover 20.

When the rotating handle 60 is assembled to the mascara cover 60 in the manner of under-cut connection, the activity restriction protrusions 51*a* and 51*b* are inserted into the restriction groove 61*a* and 61*b* formed inside.

After assembling of the rotating handle 60 is completed, the battery 3 is settled into the battery settling groove 51 of the rotary switch 50.

The minus pole and plus pole of the battery 3 become to contact with the battery minus pole terminal 53 and the battery plus pole terminal 52, respectively.

After the battery 3 is installed to the rotary switch 50, the battery cap 62 is installed to the rotating handle 60.

When the mascara cover 20 is assembled completely by assembling the motor 1, the decelerator 2 to decelerate the rotation speed of the motor 1 and the rotary switch 50 to switch paths to supply power to the motor 1, the wand 70, where the rubber brush 80 is installed, is inserted to the rotation axis 2*a* of the decelerator 2.

An inserting portion 84, which is protruded from an end of the rubber brush 80, is inserted into an assembling hole 72, which is formed on the front edge of the wand 70.

When the wand 70 is inserted, a D-cutting hole 71, which is formed on the front edge of the wand 70, is inserted into the rotation axis 2*a* of the decelerator 2 while the upper portion of the wand 70 is placed toward the bottom portion of the mascara cover 20.

When making up eyelash by using the electric mascara being assembled as described above, an amount of mascara solution contained in the mascara container 10 is applied to the rubber brush 80 installed to the wand 70.

The rubber brush 80 is pulled out from the mascara container 80 while an amount of mascara solution is applied to the rubber brush 80.

After that, the rubber brush 80 is rotated by operating the rotating handle 60 installed on the mascara cover 20.

FIG. 13 shows a state where power of the battery 3 is disconnected as the rotating handle is placed at the center. It can be seen that any of the battery plus contacting terminal 52 and the battery minus contacting terminal 53 of the battery 3 is not connected to any of the pole contacting pieces 21*a* and 21*b*.

When making up eyelash by rotating the rubber brush 80, the rotating handle 60 is rotated clockwise or counterclockwise.

When the rotating handle 60 is rotated clockwise as shown in FIG. 14, the battery plus contacting terminal 52, which is connected to the plus pole of the battery 3, is connected to the pole contacting piece 21*a*, which is connected the plus pole terminal 1*a* of the motor 1, thereby a plus pole of the battery 3 is connected to the pole contacting piece 21*a*. While the battery minus contacting terminal 53, which is connected to the minus pole of the battery 3, is connected to the pole contacting piece 21*b*, which is connected the minus pole terminal 1*b* of the motor 1; thereby a minus pole of the battery 3 is connected to the pole contacting piece 21*b*.

As the power of the battery 3 is supplied to the motor 1, the rubber brush 80, installed on the wand 70, is rotated in the forward direction that is, clockwise.

When the rotating handle 60 is rotated counterclockwise as shown in FIG. 15, the battery plus contacting terminal 52, which is connected to the plus pole of the battery 3, is connected to the pole contacting piece 21*b*, which is connected the minus pole terminal 1*b* of the motor 1, thereby a plus pole of the battery 3 is connected to the minus contacting piece 21*b*. While the battery minus contacting terminal 53, which is connected to the minus pole of the battery 3, is connected to the pole contacting piece 21*a*, which is connected the plus pole terminal 1*a* of the motor 1; thereby a minus pole of the battery 3 is connected to the pole contacting piece 21*a*.

As the power of the battery 3 is supplied to the motor 1, the rubber brush 80 installed on the wand 70 is rotated in the reverse direction that is, counterclockwise.

Thus, making up of eyelash can be done by the rubber brush 80 whose rotation direction is selectable by the rotary switch 50. Noise generated when the motor 1 and the decelerator 2 rotate are operated is hardly heard to a user because the motor 1 and the decelerator 2 are covered by the silicon cover 40.

If the rubber brush 80, whose rotational direction is selectable, gets touched to eyelash, mascara solution, which are loaded on the groove 83 of the rubber brush 80, where tooth brush 81 is formed by consecutive thread 82 and groove 83, is applied to eyelash. And eyelash can be combed up in order because thread 82 is placed alongside of eyelash while eyelash is curled up automatically.

The invention claimed is:

1. An electric mascara having a wand which is rotated by a motor installed in a mascara cover, the electric mascara comprising:

a rubber brush where teeth are formed by consecutive thread and groove, and being installed to the end portion of the wand;

pole contacting pieces installed in fixing holders of the mascara cover;

a rotary switch, for switching rotating direction of the motor, comprising: a plus contacting terminal and a minus contacting terminal which are selectively connected to the pole contacting pieces; a battery settling groove to settle a battery; and a sliding plate installed above the motor through which the rotary switch is rotated in a sliding manner; and a rotating handle, for switching rotating direction of the motor along with the rotary switch, installed on the mascara cover;

wherein the pole contacting pieces are connected either to a plus pole terminal of the motor or a minus pole terminal of the motor, wherein the rotary switch further comprises activity restriction protrusions and the rotating handle further comprises restriction grooves therein;

wherein the activity restriction protrusions are inserted into the restriction grooves so that the rotary switch and the rotating handle rotate together.

2. The electric mascara as claimed in claim 1, wherein a rotation speed of the rubber brush is ranged within 25 rpm through 30 rpm.

3. An electric mascara having a wand which is rotated by a motor installed in a mascara cover, the electric mascara comprising:

a rubber brush where teeth are formed by consecutive thread and groove, and being installed to the end portion of the wand;

pole contacting pieces installed in fixing holders of the mascara cover;

a rotary switch, for switching rotating direction of the motor, comprising: a plus contacting terminal and a minus contacting terminal which are selectively connected to the pole contacting pieces; a battery settling groove to settle a battery; and a sliding plate installed above the motor through which the rotary switch is rotated in a sliding manner;

a rotating handle, for switching rotating direction of the motor along with the rotary switch, installed on the mascara cover;

a decelerator-attached motor; and a silicon cover to cover the decelerator-attached motor, wherein the pole contacting pieces are connected either to a plus pole terminal of the motor or a minus pole terminal of the motor.

4. The electric mascara as claimed in claim 3, wherein a rotation speed of the rubber brush is ranged within 25 rpm through 30 rpm.

5. An electric mascara having a wand which is rotated by a motor installed in a mascara cover, the electric mascara comprising:

a rubber brush where teeth are formed by consecutive thread and groove, and being installed to the end portion of the wand;

pole contacting pieces installed in fixing holders of the mascara cover;

a rotary switch, for switching rotating direction of the motor, comprising: a plus contacting terminal and a minus contacting terminal which are selectively connected to the pole contacting pieces; a battery settling groove to settle a battery; and a sliding plate installed above the motor through which the rotary switch is rotated in a sliding manner; and a rotating handle, for switching rotating direction of the motor along with the rotary switch, installed on the mascara cover;

wherein the pole contacting pieces are connected either to a plus pole terminal of the motor or a minus pole terminal of the motor, wherein the rotary switch rotates inside operating grooves, formed on the upper contacting part of the mascara cover.

6. The electric mascara as claimed in claim 5, wherein a rotation speed of the rubber brush is ranged within 25 rpm through 30 rpm.

* * * * *